US006024172A

United States Patent [19]

Lee

[11] Patent Number: 6,024,172

[45] Date of Patent: Feb. 15, 2000

[54] BLOW-OUT PREVENTER

[76] Inventor: Daniel Lee, Site 43, Box 11, R.R. #4, Calgary, Canada, T2M 4L4

[21] Appl. No.: 09/071,044

[22] Filed: May 1, 1998

[51] Int. Cl.[7] ..... E21B 33/06

[52] U.S. Cl. ..... 166/363; 166/82.1; 166/84.3; 166/84.4; 166/85.4; 166/86.2

[58] Field of Search ..... 166/82.1, 84.3, 166/84.4, 85.3, 85.4, 86.2, 363, 387

[56] References Cited

U.S. PATENT DOCUMENTS

Re. 16,607 5/1927 Crowell .
778,591 12/1904 Layne .
3,939,910 2/1976 Bruce .
4,307,783 12/1981 Lanmon ..... 166/379
4,325,409 4/1982 Roberts ..... 166/321
4,531,580 7/1985 Jones .
5,074,518 12/1991 Berry .

*Primary Examiner*—Roger Schoeppel
*Attorney, Agent, or Firm*—Zarley, McKee, Thomte, Voorhees & Sease

[57] ABSTRACT

The invention provides a versatile blow-out preventer having a hydraulically activated bladder and a mechanically operated set of rams mounted in a single body, occupying a minimum of vertical space, and being adapted to operate whether or not there is equipment such as pump rods or cables in the well head.

16 Claims, 5 Drawing Sheets

BLOW-OUT PREVENTER

This invention relates to blow-out preventers. More specifically, it relates to an improved design for blow-out preventers useful in oil well production facilities and capable of providing varied and effective protection while occupying a minimum of well head space.

One of the primary concerns in oil well production is the possibility that a well will, under certain circumstances, begin to flow at high rates and high pressure and become uncontrollable. The result may be at least large toxic spillage or at worst the danger of explosion and fire.

For this reason it has long been desirable, as well as mandatory, that safety devices be employed which will prevent this sort of accident. Devices of this nature are referred to as blow-out preventers (or sometimes BOPs) and are designed to shut off the production lines of an oil well or gas well at the well head in the event that the well begins to flow out of control.

Because some wells flow freely under their own pressure, while other wells are required to be pumped, blow-out preventers must be capable of activating under either one or both of the foregoing situations, that is with or without pump rods, wire lines or tubing in the well head.

Historically, various types of BOPs have provided means for shutting off the flow at the well head. Some provide rams, either hydraulic or manual, capable of cutting off rods, wire or tubing. Some provide rams which are capable of enclosing any well head equipment such as rods or wire or tubing. Some provide flexible elastomeric members capable of adjusting to the shape of any obstructions which may be in the production line and thus forming a seal.

In the case of drilling wells large highly powerful BOPs are used which are capable of shearing drill pipe but the present invention is directed primarily to the production wells.

Although a variety of existing devices have previously been disclosed and are generally available, few, if any, provide a variety of functions capable of reacting to different situations depending on whether or not there is any pumping equipment in the well or not, and what sort of obstruction might be in place.

Furthermore, although it is possible to connect different types of blow-out preventers together in sequence, such an arrangement generally results in a very large well head facility and requires that workers reach some of the equipment using ladders or other elevated facilities that present additional hazards and workers' compensation problems.

It is therefore one of the purposes of the present invention to provide a blow-out preventer which is capable of responding in an effective way to a variety of conditions in the well head.

It is also a purpose of this invention to provide a blow-out preventer which is also compact and does not complicate the ability of workers to work on the well head equipment.

These features and other advantages are provided by the present invention in which a blow-out preventer comprises a body having a central bore, adapted to receive pump rods, cables, or fluid flow; a cylindrical chamber formed in said body concentric with said central bore and housing a bladder capable of compression to seal said central bore; a chamber surrounding said bladder to accommodate hydraulic fluid to activate said bladder; and a source of hydraulic pressure to said chamber. The body also has a pair of perpendicular cylinders formed in said body and a pair of rams mounted to move axially therein from an open position outside of the perimeter of said central bore to a closed position intersecting said central bore; and means to activate said rams.

The blower preventer may also include a tee-flow channel to allow well head fluids to be discharged. The rams may be provided with different faces to permit sealing against cables or pump rods, or alternatively, against each other if no equipment is in the central bore.

In the preferred embodiment the rams are provided with threaded activating screws which may be operated manually to close the rams and a source of hydraulic pressure is provided to activate the bladder.

Ideally, the blow-out preventer is capable of mounting to a well head and has means for fitting a stuffing box to the top end thereof.

These features may be better understood by a description of one embodiment of the invention with reference to the attached drawings in which.

Figure 1:
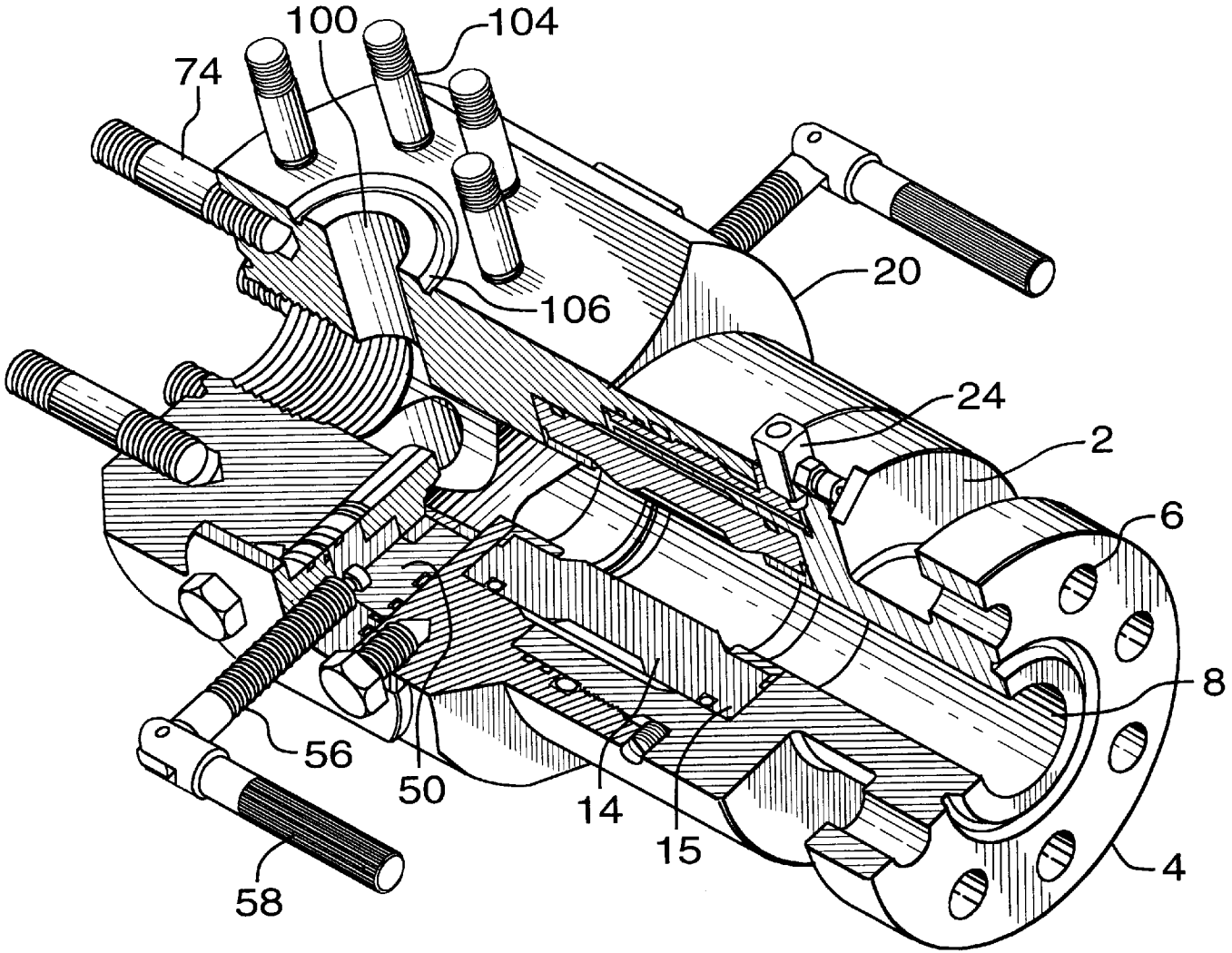
FIG. 1 is a perspective cut away view of blow-out preventer constructed in accordance with the present invention.
Figure 4A:
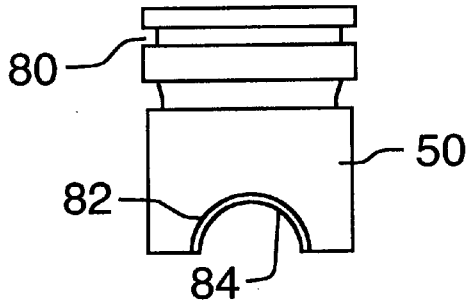
Figure 4B:
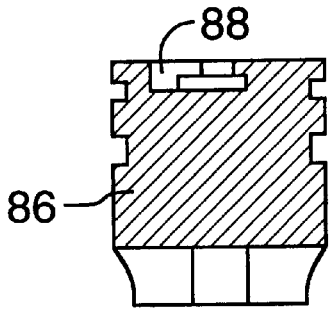

FIG. 4*a* is a horizontal cross-section of a portion of the structure in FIG. 1;

FIG. 4*b* is a vertical cross-section of the portion in FIG. 4*a;*

Figure 4C:
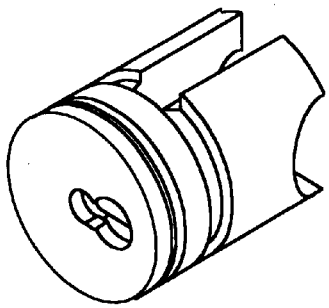

FIG. 4*c* is a perspective view of the part in FIG. 4*a;*

Figure 2:
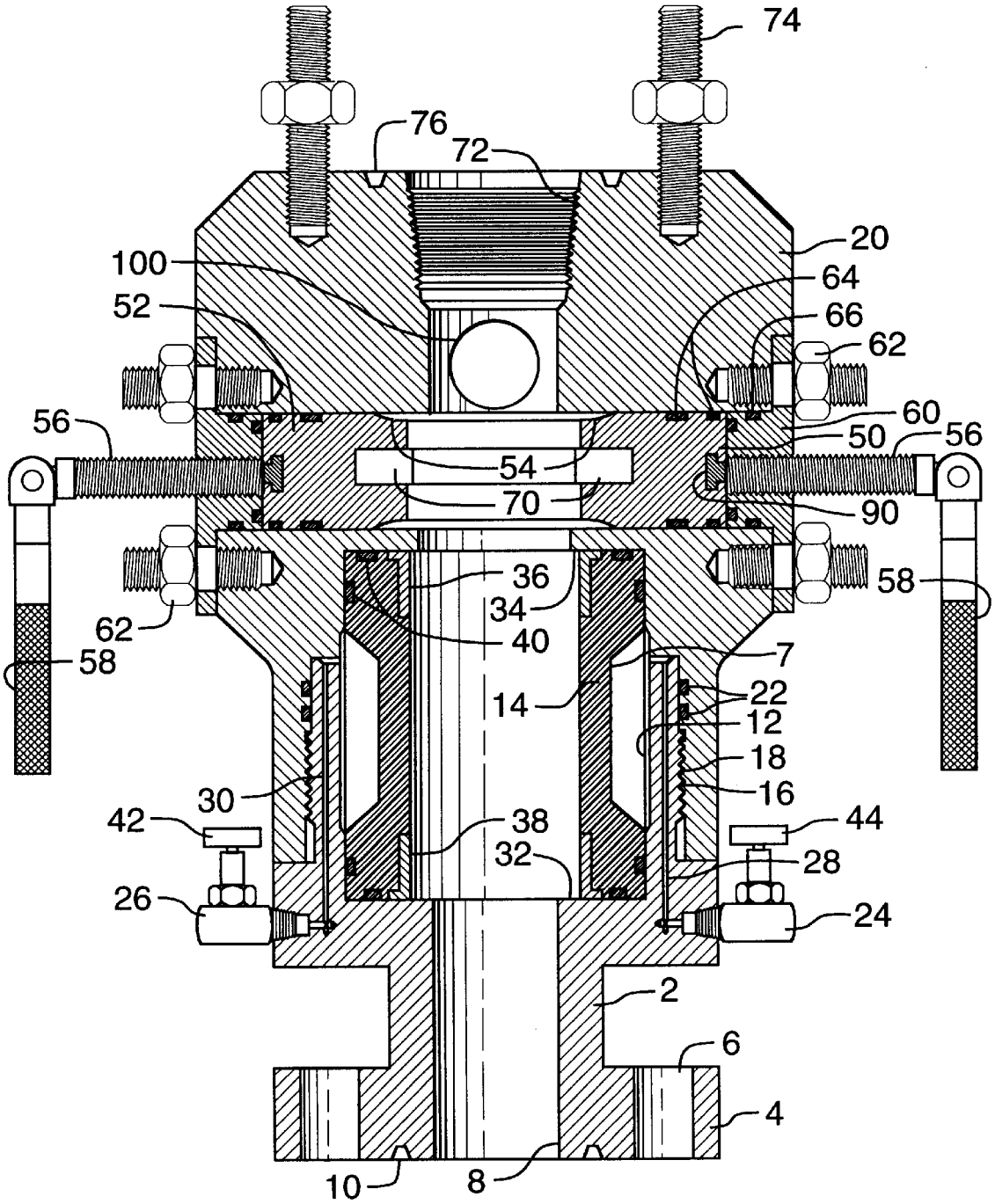
FIG. 2 is a vertical cross-section of the invention illustrated in FIG. 1.
Figure 3:
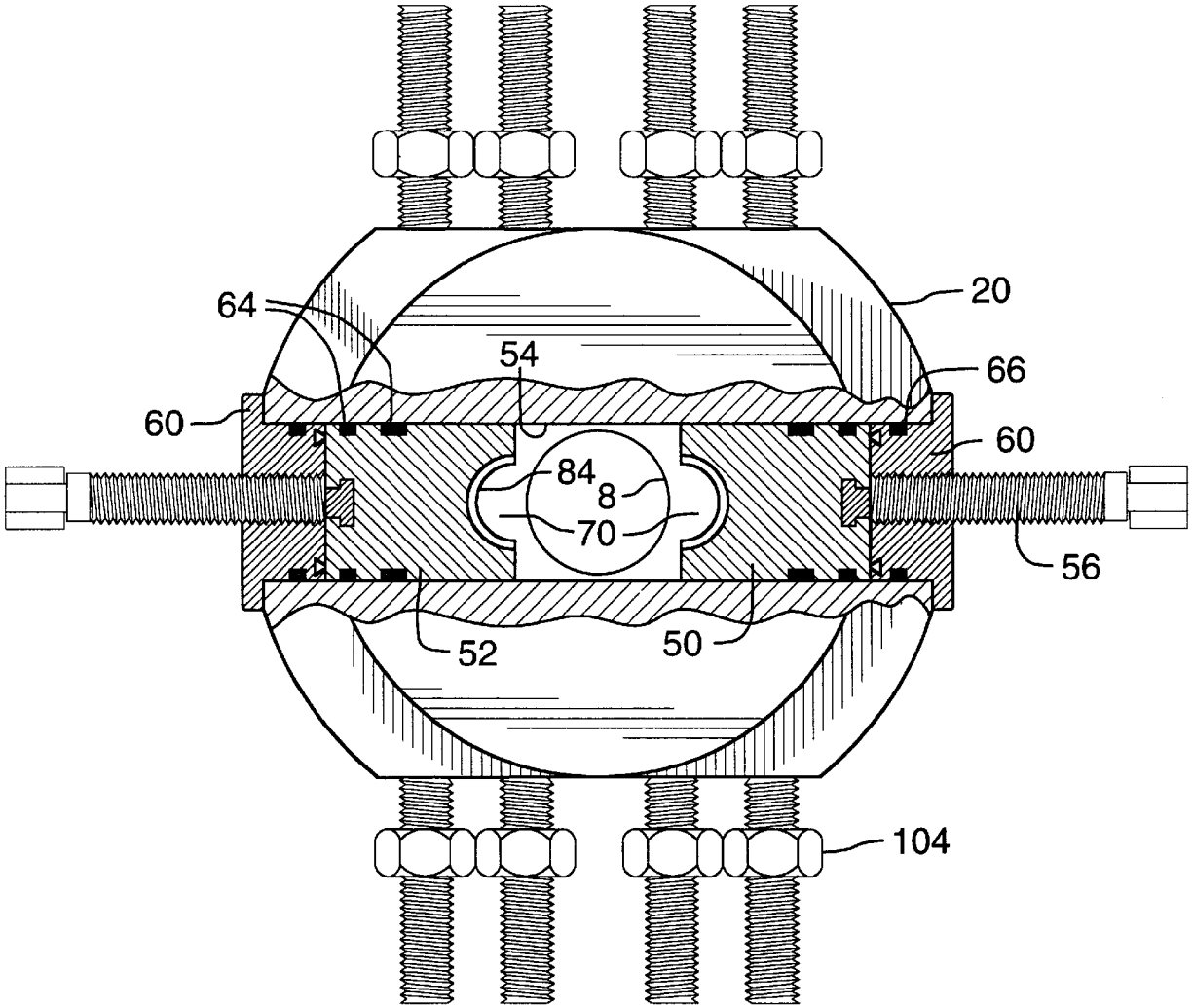
FIG. 3 is a horizontal cross-section of the invention in FIG. 1.
Figure 5:
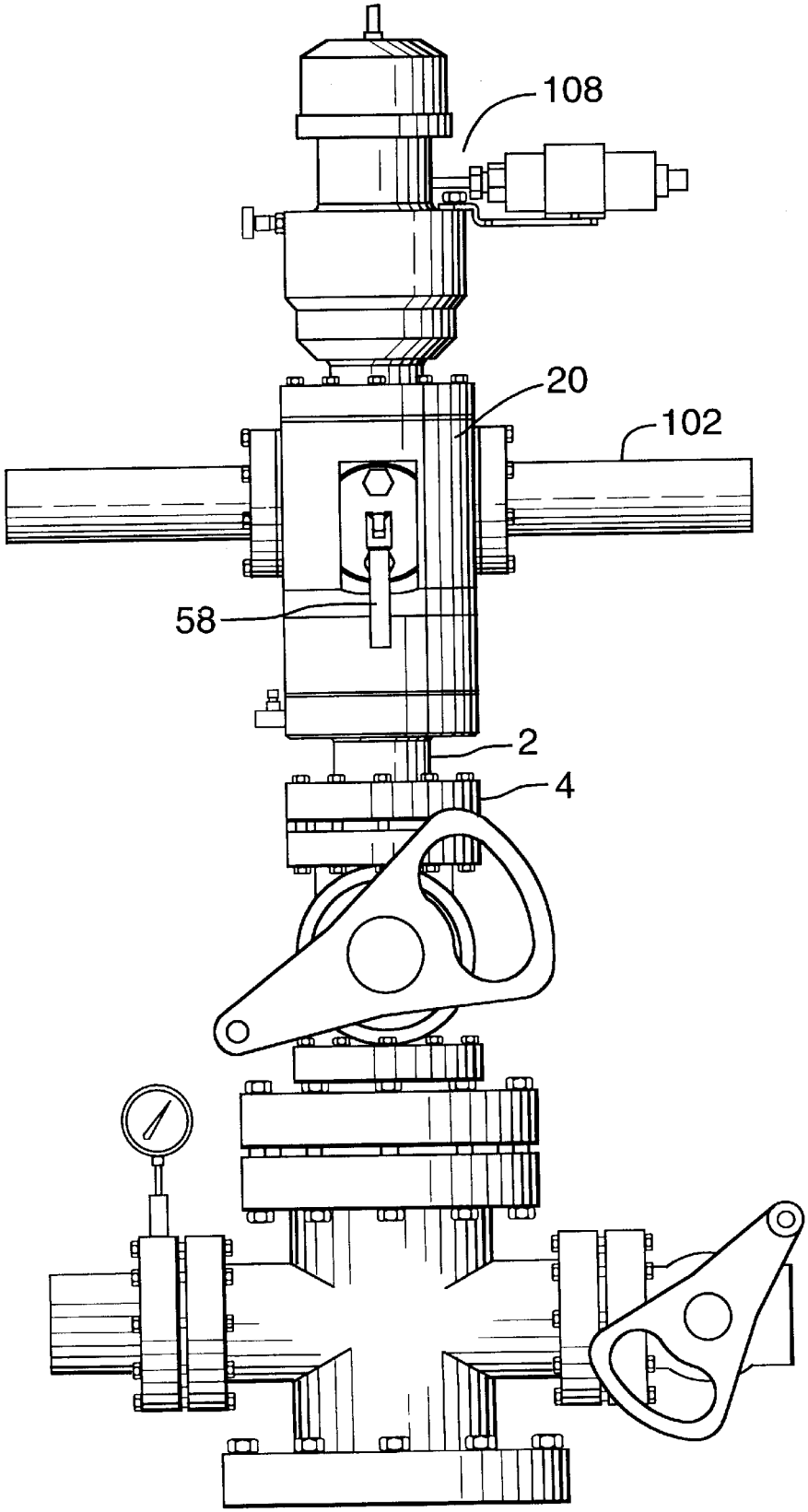

FIG. 5 is a vertical elevation of the invention in FIG. 2.

In the illustrated embodiment the lower body portion 2 has a flange 4 with bolt holes 6 capable of being mounted to the flange of a well head at the top of the production tubing by conventional means.

The central bore 8 is designed to be aligned with the production tubing and seal rings in the groove 10 provide a fluid tight connection.

A larger diameter chamber is provided at 12 to create a recess of larger diameter than the central bore and is designed to house an elastomeric bladder 14 which will be discussed in greater detail later.

The lower body portion has an external thread 16 by which is connected to a corresponding female thread 18 on the lower end of the upper body portion 20 with fluid tight seals as shown at 22.

The lower body portion also has a pair of valves 24 and 26 each connected to a hydraulic channel 28 and 30 which lead to the chamber 12 behind the bladder 14.

The bladder 14 constitutes a somewhat modified cylindrical ring made of a natural or polymer rubber or urethane so that it is semi-rigid but flexible under sufficiently large forces. The bladder is dimensioned to fit snugly within the recess provided by the bore 12 and the end walls of the bore 32 and 34 where the ends of the ring of the bladder are held in place by retaining rings 36 and 38 which serve to prevent excessive distortion near the ends of the bladder. In addition, seals such as illustrated at 40, provide a seal to control any hydraulic fluid in the chamber between the bladder and the bore 12.

The bladder 14 is provided with a series of longitudinal grooves 15 which aid in allowing the bladder to collapse inwardly under hydraulic pressure in a regular symmetrical manner and allows the bladder to seal either against a cable or pump rod, or against itself in the event that there is no equipment in the central bore.

Access to this chamber by hydraulic fluid may be controlled by the manual valve handles 42 and 44 respectively, or may be activated by some remote control or automatic means interposed between the valves 24 and 26 and the source of hydraulic fluid pressure.

Immediately above the bladder chamber a pair of rams 50 and 52 are mounted horizontally in the side walls of the upper body 20.

The rams are designed to move in the cylindrical channels 54 by means of the threaded activators 56 which are manually operated by means of the handles 58. The threads 56 are mounted in the retaining flanges 60 mounted to side wall of the upper body by means of the bolts 62.

As illustrated the rams are withdrawn to leave the central bore unobstructed and are provided with seal rings 64 to prevent escape of fluid from the central bore. The retaining flanges are likewise provided with seals 66 to provide a fluid tight enclosure. The face of the rams 70 are provided with semi-circular recesses (best seen in FIGS. 4*a* and 4*b*) designed to surround pump rods, wire cable or tubing, depending on what equipment may be in use in the well head.

The top of the upper body 20 is provided with a threaded bore 72 capable of connection to a male threaded production pipe and also provided with bolts 74 capable of fastening additional well head equipment with a seal ring at 76, if desired. In FIG. 4*a* ram 50 is illustrated in horizontal cross-section with a recess groove 80 to receive a seal ring and a semi-circular recess 82 which receives a stiff rubber or plastic insert 84 in the groove 86 shown in FIG. 4*b*. The end of the threaded shaft 56 may be removably attached to the ram by means of an offset opening 88 which is also illustrated in FIG. 4*c* and is adapted to receive the flanged lug 90 as seen in FIG. 2.

It will, of course, be realized that the face of the rams may be modified depending on the equipment in the hole or may in fact be flat, in the event that they are to be used when there is no equipment in the central bore, so that they can close against each other.

In addition, the present invention provides for a "flow tee" immediately above the rams in a horizontal direction perpendicular to the axes of the movement of the rams. The bore 100 provides flow to lines 102 illustrated in FIG. 5 which may be attached by means of the bolts 104 and sealed by an appropriate ring in the grooves 106 in a convention manner. Such a system might be used where a stuffing box (108 in FIG. 5) or other facilities are mounted to the top of the upper body of the BOP by means of bolts such as 74.

Thus, by means of the present invention as illustrated in the foregoing description, a versatile BOP is provided which may be bolted to a well head and will occupy very little vertical dimension so that the pump stroke may be maximized and part of the well head will not be difficult to reach by workers. In addition, the rams provide for a mechanically manually operated system to secure against polished rods, tubing, wire cable, or whatever may be in the well head, or if appropriate, to seal tightly against each other and will substantially prevent the unregulated flow of fluid from the hole and prevent tubing or pump rods from being driven out of the well by bore pressure. At the same time the bladder may be activated manually or automatically to inflate the bladder and seal off the production line either around rods tubing or wire cable or to seal against itself in the event that there is nothing in the hole.

It will, of course, be realized that the rams shown in the illustrated embodiment may be hydraulically operated. It is also possible that a single ram could effect the same purpose.

Therefore, by means of the present invention a small compact effective and versatile means of controlling oil and gas wells is provided, with two controlling methods in one piece of equipment without interfering with the production operation or causing excessive elevation of the equipment, and this compact design may result in allowing for an increased length of pump stroke and therefore more pumping efficiency.

It will, of course, be realized that numerous modifications and variations of the illustrated embodiment may be employed without departing from the inventive concept herein.

I claim:

1. A blower preventer of the type used in oil production wells comprising:

a body, mountable to a well head, and having a central bore;

said body having a cylindrical chamber axially concentric with said central bore and a cylindrical bladder mounted therein capable of deformation into said central bore;

a chamber surrounding said bladder to accommodate hydraulic fluid to activate said bladder;

a source of hydraulic pressure communicating to said chamber;

control means to activate or deactivate said source of hydraulic pressure;

at least one perpendicular cylinder formed in said body adjacent to said central bore;

at least one ram mounted in said cylinder and movable between an open position outside of the perimeter of said central bore and a closed position intersecting the central bore;

and means to activate said rams.

2. Apparatus as claimed in claim 1 in which said means to activate said rams include a manually operable threaded screw means.

3. Apparatus as claimed in claim 2 in which said hydraulic means is controlled automatically.

4. Apparatus as claimed in claim 2 in which the face of said rams is provided by interchangeable pieces adapted to conform to the shape of a cable or a pump rod which may be in the central bore.

5. Apparatus as claimed in claim 2 in which the rams have faces adapted to seal against each other when no equipment is in the central bore.

6. Apparatus as claimed in claim 2 including a flow-tee adapted to discharge well head fluid above said bladder and said rams.

7. Apparatus as claimed in claim 2 including means for mounting a stuffing box on the upper end of said body.

8. Apparatus as claimed in claim 1 in which said hydraulic means is controlled automatically.

9. Apparatus as claimed in claim 8 in which the face of said rams is provided by interchangeable pieces adapted to conform to the shape of a cable or a pump rod which may be in the central bore.

10. Apparatus as claimed in claim 8 in which the rams have faces adapted to seal against each other when no equipment is in the central bore.

11. Apparatus as claimed in claim 8 including a flow-tee adapted to discharge well head fluid above said bladder and said rams.

12. Apparatus as claimed in claim 8 including means for mounting a stuffing box on the upper end of said body.

13. Apparatus as claimed in claim 1 in which the face of said rams is provided by interchangeable pieces adapted to conform to the shape of a cable or a pump rod which may be in the central bore.

14. Apparatus as claimed in claim 1 in which the rams have faces adapted to seal against each other when no equipment is in the central bore.

15. Apparatus as claimed in claim 1 including a flow-tee adapted to discharge well head fluid above said bladder and said rams.

16. Apparatus as claimed in claim 1 including means for mounting a stuffing box on the upper end of said body.

* * * * *

UNITED STATES PATENT AND TRADEMARK OFFICE

CERTIFICATE OF CORRECTION

PATENT NO. : 6,024,172

DATED : February 15, 2000

INVENTOR(S) : LEE, Daniel

It is certified that error appears in the above-identified patent and that said Letters Patent is hereby corrected as shown below:

Column 4, line 28, strike the numeral "2" and insert the numeral - 1 -.

Column 4, line 30, strike the numeral "2" and insert the numeral - 1 -.

Column 4, line 34, strike the numeral "2" and insert the numeral - 1 -.

Column 4, line 37, strike the numeral "2" and insert the numeral - 1 -.

Column 4, line 39, strike the numeral "2" and insert the numeral - 1 -.

Column 4, line 41, strike the numeral "1" and insert the numeral - 2 -.

Column 4, line 43, strike the numeral "8" and insert the numeral - 2 -.

Column 4, line 47, strike the numeral "8" and insert the numeral - 2 -.

Column 4, line 50, strike the numeral "8" and insert the numeral - 2 -.

Column 4, line 53, strike the numeral "8" and insert the numeral - 2 -.

Column 4, line 55, strike the numeral "1" and insert the numeral - 3 -.

UNITED STATES PATENT AND TRADEMARK OFFICE

CERTIFICATE OF CORRECTION

PATENT NO. : 6,024,172

DATED : February 15, 2000

INVENTOR(S) : LEE, Daniel

It is certified that error appears in the above-identified patent and that said Letters Patent is hereby corrected as shown below:

Column 4, line 59, strike the numeral "1" and insert the numeral - 3 -.

Column 4, line 62, strike the numeral "1" and insert the numeral - 3 -.

Column 4, line 65, strike the numeral "1" and insert the numeral - 3 -.

Signed and Sealed this

Sixth Day of February, 2001

*Attest:*

*Attesting Officer*

Q. TODD DICKINSON

*Director of Patents and Trademarks*